US010455991B2

(12) United States Patent
Wedi

(10) Patent No.: US 10,455,991 B2
(45) Date of Patent: Oct. 29, 2019

(54) SHOWER FLOOR PANEL WITH FUNCTIONAL ELEMENT

(71) Applicant: wedi GmbH, Emsdetten (DE)

(72) Inventor: Stephan Wedi, Emsdetten (DE)

(73) Assignee: Wedi GmbH, Emsdetten (DE)

( * ) Notice: Subject to any disclaimer, the term of this patent is extended or adjusted under 35 U.S.C. 154(b) by 453 days.

(21) Appl. No.: 14/626,355

(22) Filed: Feb. 19, 2015

(65) Prior Publication Data

US 2016/0235256 A1 Aug. 18, 2016

(30) Foreign Application Priority Data

Feb. 17, 2015 (DE) ..... 10 2015 102 247

(51) Int. Cl.
*A47K 3/40* (2006.01)

(52) U.S. Cl.
CPC ..... *A47K 3/40* (2013.01)

(58) Field of Classification Search
CPC ..... A47K 3/40; A47K 3/405; E03C 1/20
USPC ..... 4/288, 604, 612, 613, 695; 52/264
See application file for complete search history.

(56) References Cited

U.S. PATENT DOCUMENTS 7,472,719 B2 * 1/2009 Dallmer ..... E03F 5/0408 137/362
8,347,906 B1 * 1/2013 Ismert ..... E03F 5/0407 137/15.01
2009/0320204 A1 * 12/2009 Wiseman ..... A47K 3/40 4/613
2010/0043136 A1 * 2/2010 Michael ..... A47K 3/40 4/613
2013/0000035 A1 * 1/2013 Wedi ..... E03F 5/0407 4/681

FOREIGN PATENT DOCUMENTS

DE 102006007471 * 6/2012 ..... A47K 3/40
DE 102006007471 B4 9/2012

OTHER PUBLICATIONS

"Use Wood Floor in Showers to Create an Exciting and Natural Ambiance", Orak Home and Garden. Published Oct. 14, 2014. <http://ortak.co/wood-floor-showers-exciting-natural-ambiance/>.*
German Patent and Trademark Office, "Office Action dated Dec. 15, 2015 in related German Patent Application No. 10 2015 102 247.8", Dec. 15, 2015, Germany.

* cited by examiner

*Primary Examiner* — Erin Deery
*Assistant Examiner* — Nicholas A Ros
(74) *Attorney, Agent, or Firm* — The Law Office of Michael E. Kondoudis

(57) ABSTRACT

A shower base panel module that includes: a panel element; a continuous borehole provided on the panel element, an annular body accommodated in the borehole for inserting a drain element. The panel element has a first pan-shaped surface and a second planar surface facing away from the first surface, so that the outer edge of the panel element has a panel thickness that exceeds a panel thickness at the borehole. The annular body protrudes beyond the second planar surface in the drain direction. A reinforcement body, which receives the annular body protruding beyond the planar surface, is placed beneath the second planar surface of the panel element.

19 Claims, 6 Drawing Sheets

SHOWER FLOOR PANEL WITH FUNCTIONAL ELEMENT

CROSS-REFERENCE TO RELATED APPLICATION

This application claims the benefit of German patent application no. 102015102247.8, filed 17 Feb. 2015, now pending.

BACKGROUND

The invention relates to a shower base panel module, comprising:

a panel element;

a continuous borehole provided on the panel element, wherein the panel element has a first pan-shaped surface and a second planar surface facing away from the first surface, such that the outer edge of the panel element has a panel thickness that exceeds a panel thickness at the borehole; and an annular body accommodated in the borehole for receiving a drain element, wherein the annular body protrudes beyond the second planar surface in the drain direction, and wherein a reinforcement body, which receives the annular body protruding beyond the planar surface, is placed beneath the second planar surface of the panel element.

A shower base panel module 200 of the type mentioned above is shown in FIG. 7. The shower base panel module is composed of a panel element 1 having a continuous borehole 3 and a reinforcement body 2, which are adhesively bonded to each other (see bottom of FIG. 7). The plate-shaped reinforcement body 2 has a second continuous borehole 17, which coincides with the borehole 3 of the panel element 1 when the shower base panel module 200 is assembled. The reinforcement body 2 is made of the same material as the panel element 1, and is rectangular and relatively thick, such that the shape thereof resembles a cuboid.

It is the object of the invention to design a novel shower base panel module of the type described in the preamble, which does not require the expansive shape of the reinforcement body. Moreover, the novel shower base panel module is to be designed so that it can be installed flush with the surface in a wooden floor structure of a shower stall.

This object is achieved by a shower base panel module of the type in question, resulting from designing the reinforcement body as a flattened, annular functional element produced in one material piece, which has a circular axial opening to receive the drain element. The reinforcement body not only fulfills a mechanically stabilizing function for the panel element, but is also used as a fastening element for receiving a drain element or an adapter.

The reinforcement body is preferably produced from a corrosion-resistant material, and preferably from stainless steel sheet using a deep drawing or metal spinning process.

The required rigidity for the reinforcement body can be achieved by appropriate shaping. For example, the metal reinforcement body can comprise a flange that transitions into a pan and has peripheral beads, wherein the aforementioned opening for receiving the drain element is located on the pan bottom. The described reinforcement body can have approximately the shape of a dinner plate, having a cut-out bottom and a particularly wide, flat rim.

It is also possible to produce a torsion-free reinforcement body from a mechanically stable and water-resistant thermoplastic or thermoset material, such as polycarbonate. Such a reinforcement body made of plastic material can be produced using an injection molding process.

The reinforcement body can be manually or mechanically attached to the panel element and/or to the annular body by way of an adhesive bond.

A drain element shall be understood to mean a conventional drain pan having an odor trap, or a drain pipe that is to be sealed directly in the annular body by way of an adapter part.

A particular advantage of the shower base panel module according to the invention is that it can be installed in various substructure designs, for example in wooden flooring structures on a timbered ceiling, flush with the surface. Due to the especially robust, but very flat reinforcement body, the overall thickness of the shower base panel module is adapted to wooden floors where the surface of the panel element is aligned with the surface of the wooden floor. In addition, the shower base panel module according to the invention is suitable for creating what is known as a floor-level shower area.

A further advantage of the invention is that the panel element having the reinforcement body placed beneath can be covered with tiles directly on a cement layer.

Due to the stability of the shower base panel module, the body can even be used on non-load-bearing subsurfaces.

BRIEF DESCRIPTION OF THE DRAWINGS

The invention will be described in more detail in one exemplary embodiment based on the drawings. In the drawings.

DETAILED DESCRIPTION

Figure 2:
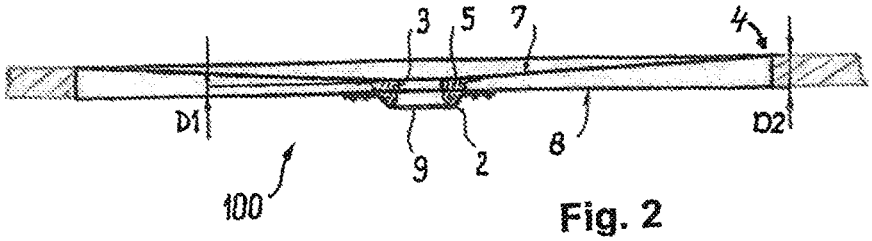
FIG. 2 shows a section A-A according to FIG. 1.
Figure 1:
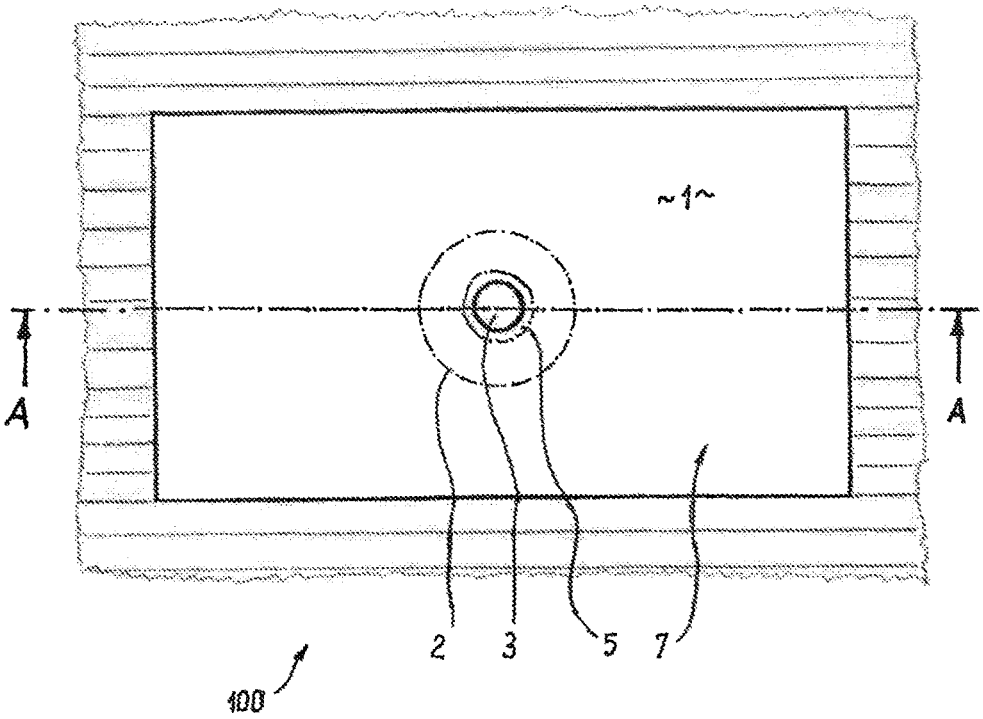
FIG. 1 shows a top view onto a shower base panel module having a pan-shaped, concave panel element surface.

FIGS. 1 and 2 schematically show a shower base panel module 100 according to the invention, which is composed of a rectangular panel element 1 and a reinforcement body 2. The panel element 1 has a pan-shaped or concave surface 7, a planar surface 8 facing away from the surface 7, and a central, continuous borehole 3. On the outer edge 4, the panel element 1 has a panel thickness of D2≤20 mm, and in the region of the borehole 3 it has a panel thickness of only D1≤5 mm. The dimensions can vary within a tolerance range that is provided for manufacturing reasons. The tolerance ranges for the dimensions are preferably 5 mm±1.5 mm and 20 mm±1.5 mm. The extraordinarily thin panel thickness D2 on the outer edge 4 approximately corresponds to the thickness of a wooden floor, which is not shown.

A profiled annular body 5 (see in particular FIG. 6) is installed into the borehole 3 in such a way that the flat outer collar 19 thereof fits in a compatible cut-out 20 on the panel element 1, wherein the outer collar 19 is joined to the panel element 1 via an adhesive layer 21.

Via a cylindrical wall 22, the outer collar 19 of the annular body 5 transitions into a body part 23, which tapers in a stepped manner and protrudes beyond the planar surface 8 of the panel element 1 and the outer surface 18 of which has a conical design.

As a result, the panel element 1 can be deformed, in particular in the region of the borehole 3, due to the thinness thereof. The installed annular body 5 reinforces the panel element 1, however under the most unfavorable conditions this reinforcement alone is not sufficient.

Figure 3:
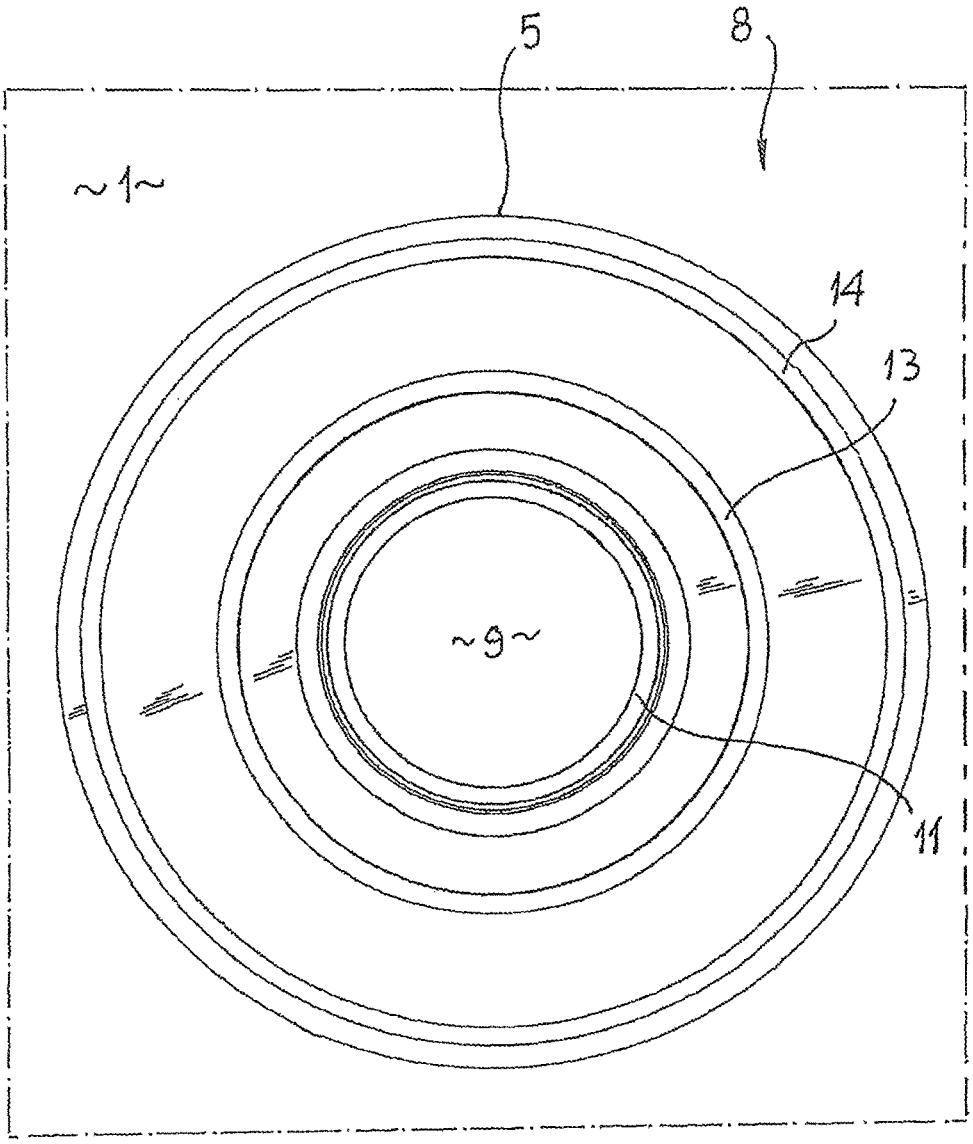
FIG. 3 shows the shower base panel module according to FIG. 2 in a top view onto a planar surface of the panel element.
Figure 4:
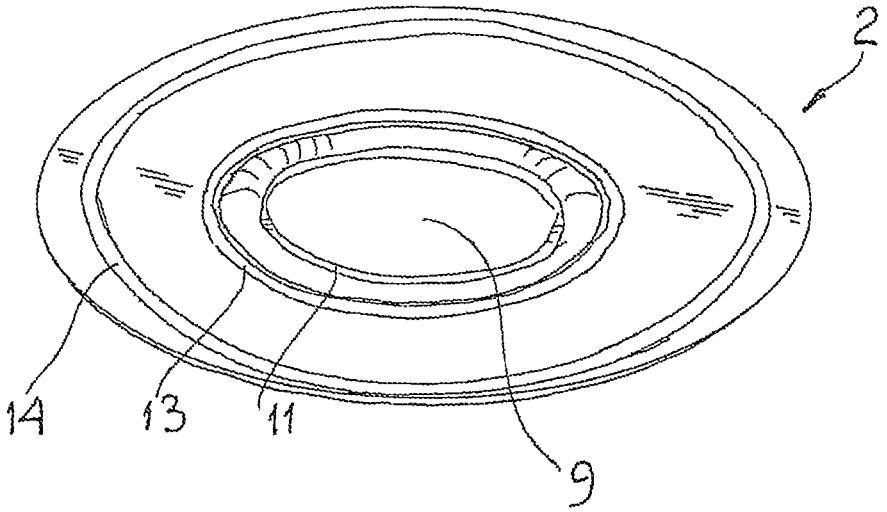
FIG. 4 shows a perspective view of the reinforcement body.
Figure 5:
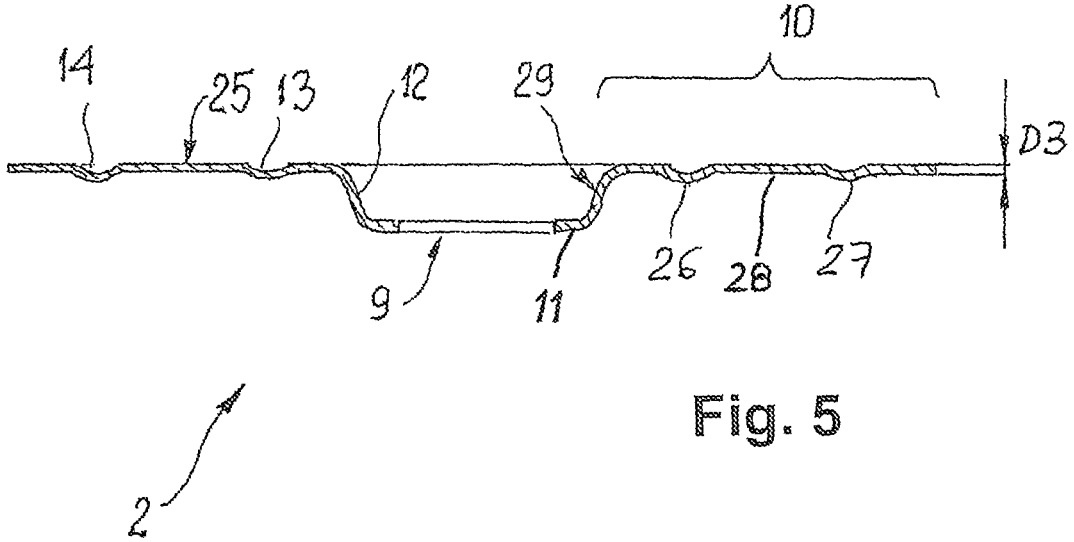
FIG. 5 shows an axial section of the reinforcement body according to FIG. 4.
Figure 8:
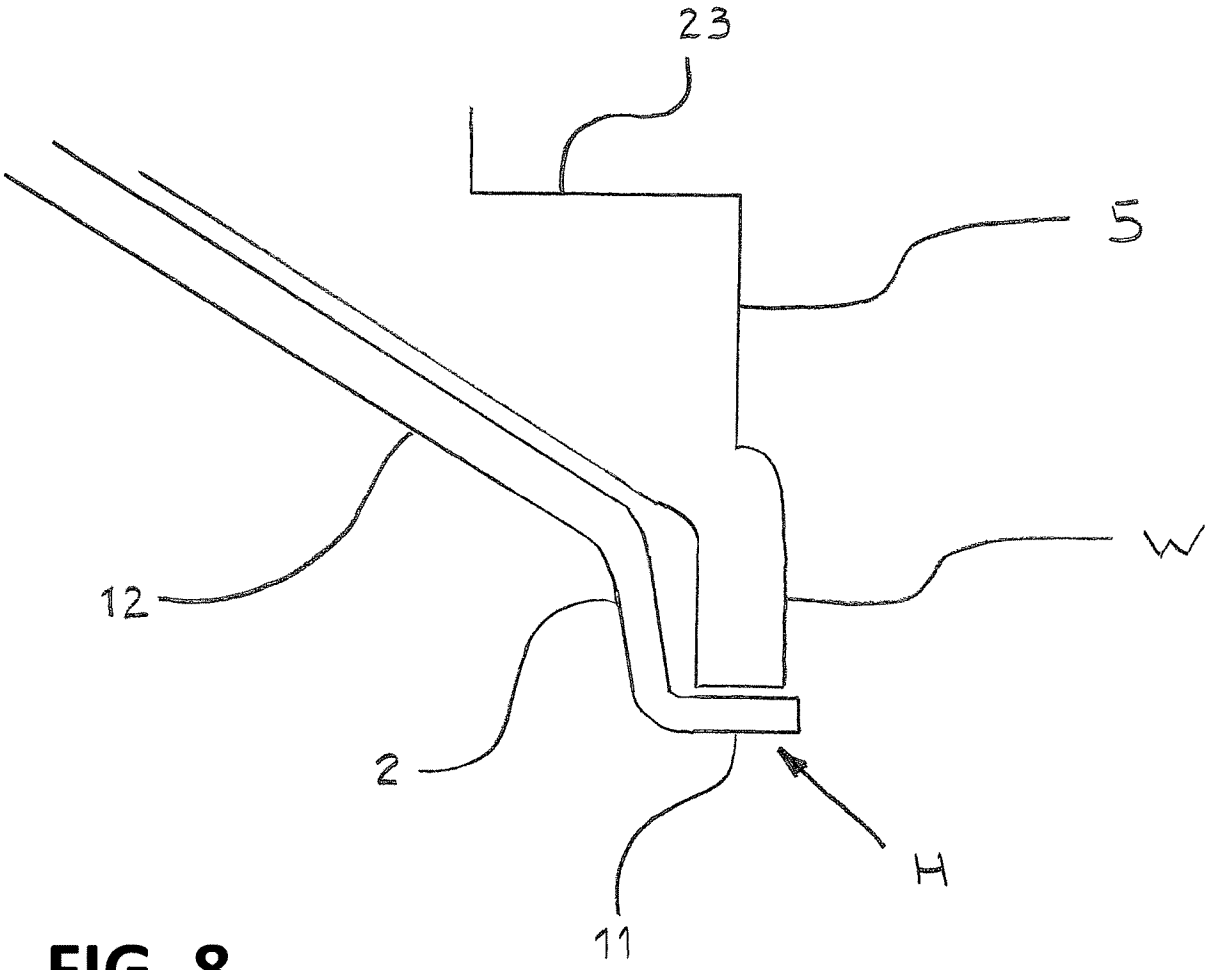
FIG. 8 shows the annular and reinforcement bodies of FIG. 6 in more detail.

The necessary stability and torsion-free design of the panel element 1 is ensured by the novel rotation-symmetrical reinforcement body 2 shown in FIGS. 3, 4 and 5, which is produced from a stainless steel sheet with a thickness D3=2 mm using a deep drawing process. The rotation-symmetrical reinforcement body 2 has a circular axial opening 9 delimited by an inner collar 11, a wide flange 10, and a peripheral oblique wall 12. Proceeding from the flange 10, the oblique wall 12 has a conical progression and transitions into the aforementioned inner wall 11. Aspects of oblique wall 12 and inner wall 11 are depicted in detail in FIG. 8.

The dimensions of the reinforcement body 2 are:

| | |
|---|---|
| outer diameter of the flange 10 | 250 mm |
| inner diameter of the flange 10 | 120 mm |
| diameter of the opening 9 | 86 mm |
| total height | 18 mm |

The dimensions can, of course, vary. What is important is that the flange 10 is amply dimensioned in relation to the borehole 3 of the panel element 1. Peripheral beads 13, 14 additionally increase the rigidity of the 2 mm thick flange 10. On a planar surface 25 of the flange 10 facing the panel element 1, the beads 13, 14 are concentrically shaped in relation to the opening 9. The beads 13, 14 thus form peripheral protrusions 26, 27 (see FIG. 5) of a "lower" surface 28 of the flange 10.

Figure 6:
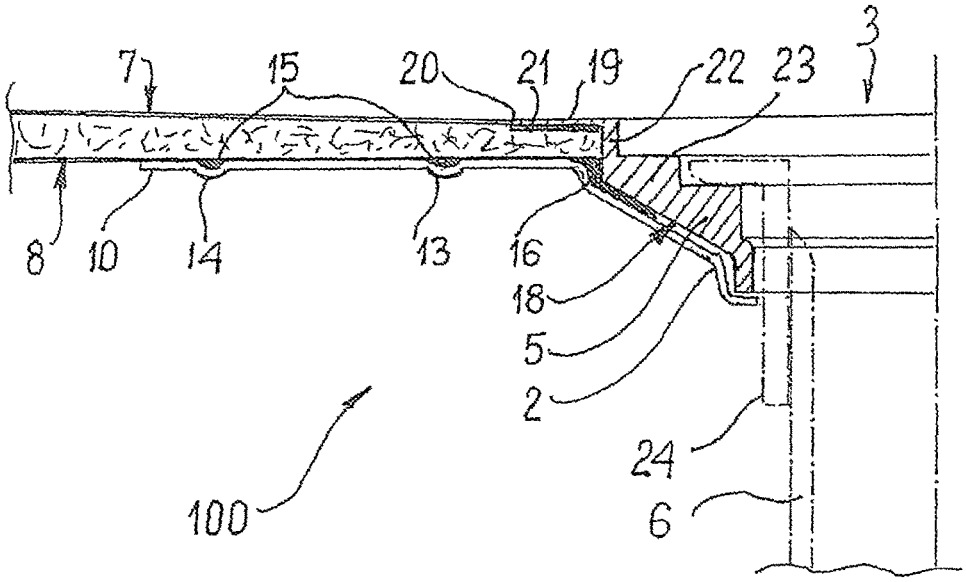
FIG. 6 shows an axial section of a detail of the assembled shower base panel module.

Finally, FIG. 6 shows details of an adhesive bond 15, 16 of the reinforcement body 2 with the panel element 1. The adhesive bond 15, 16 is created by applying a plastic-to-metal adhesive to the beads 13, 14 and at least to portions of an inner side 29 of the oblique wall 12, and subsequently exerting a contact pressure against the "lower" planar surface 8 of the panel element 1 and against the conical outer surface 18 of the annular body 5. A different adhesive bond is also possible, for example by way of coating the annular surfaces outside the beads 13, 14. The connection between the reinforcement body 2 and the panel element is waterproof.

FIG. 6 moreover shows an adapter 24, which is indicated with dash-dotted lines and inserted in the borehole 3, in or to which a drain pipe 6 can be connected, for example by way of a screw connection.

A predominantly closed-cell polystyrene foam body (XPS) is preferably used as the panel element 1, which is reinforced on both sides with glass fibers and coated with polymer-modified mortar. Such panel elements are produced and sold by the applicant under the brand name FUNDO®, for example.

LIST OF REFERENCE NUMERALS

Figure 7:
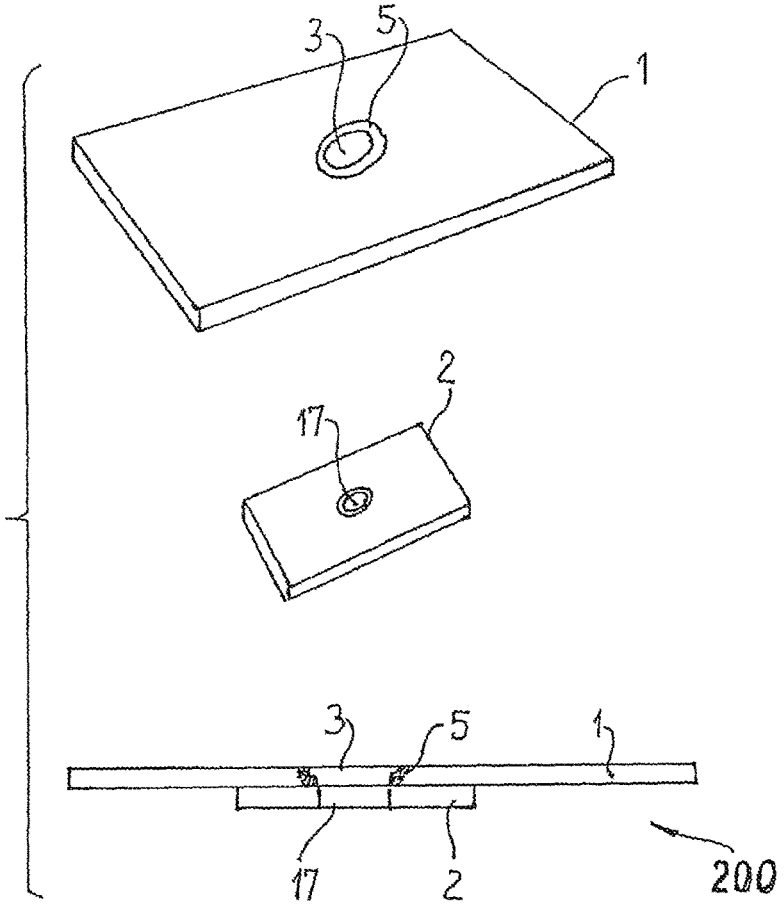
FIG. 7 shows a shower base panel module according to the prior art.

1 panel element
2 reinforcement body
3 borehole
4 outer edge
5 annular body
6 drain element
7 surface
8 surface
9 opening
10 flange (of 2)
11 inner collar (of 2)
12 oblique wall
13, 14 bead
15, 16 adhesive bond
17 borehole (FIG. 7)
18 outer surface (of 5)
19 outer collar (of 5)
20 cut-out (of 1)
21 adhesive layer (joins 19 to 1)
22 wall (of 5)
23 body part (of 5)
24 adapter
25 surface (of 10)
26, 27 protrusion (of 10)
28 surface (of 10)
29 inner side
100 shower base panel module
200 shower base panel module (prior art)
A-A section (FIG. 1)
D1, D2 panel thickness
D3 thickness

The invention claimed is:

1. A shower base panel module (100), comprising:
a panel element (1) with a cut-out (20) on a first, top surface (7) thereof;
a continuous borehole (3) provided on the panel element (1);
an annular body (5) accommodated in the borehole (3) and for receiving a drain element (6), the annular body having
a flat outer collar (19) that fits into the cut out (20),
a body part (23) having a conical outer surface,
a first cylindrical wall (22) extending from an inner periphery of the flat outer collar (19) to the body part (23), and
a second cylindrical wall (W) extending from the body part (23); and
a reinforcement body (2) that includes an oblique wall (12) and an inner collar (11) with a horizontal end portion (H) at an end of the oblique wall, the inner collar delimiting a circular axial opening (9) that accommodates the drain element (6),
wherein, in an assembled state, an end of the second cylindrical wall (W) rests on the horizontal end portion (H) and the flat outer collar (19) is fully accepted by the cut out (20) so as to be flush with the top surface (7).

2. The shower base panel module (100) according to claim 1,
wherein the panel element (1) has an outer edge (4) with a panel thickness (D2) that exceeds a panel thickness (D1) at the borehole (3), and
wherein the panel thickness (D2) of the panel element (1), when installed, does not exceed the thickness of a subfloor surrounding the panel element (1).

3. The shower base panel module (100) according to claim 1, wherein an outer edge (4) of the panel element (1) is 20 mm thick, and in the region of the borehole (3) is 5 mm thick, wherein the thickness tolerance is ±1.5 mm.

4. The shower base panel module (100) according to claim 1, wherein the reinforcement body (2) is produced from stainless steel sheet using a deep drawing or metal spinning process.

5. The shower base panel module (100) according to claim 1, wherein the reinforcement body (2) has a continuous, constant thickness (D3) of 1 mm to 3 mm.

6. The shower base panel module (100) according to claim 1, wherein, in a view from above onto the surface (7; 8), the panel element (1) is square.

7. The shower base panel module (100) according to claim 1, wherein the panel element (1) is a rigid foam body reinforced on both sides with synthetic mortar.

8. The shower base panel module (100) according to claim 1, wherein the module is recessed into a wood or wood-based covering of a floor.

9. The shower base panel module (100) according to claim 1, wherein the panel element (1) having the reinforcement body (2) placed beneath is adapted so as to be covered with tiles directly on a cement layer.

10. The shower base panel module of claim 1, wherein the reinforcement body (2) is rotationally symmetrical, which provides stability and torsion resistance.

11. A shower base panel module (100), comprising:

a panel element (1) comprising a borehole (3) extending from a top surface (7) thereof to a bottom surface (8) thereof, and an annular cut-out (20) that surrounds the borehole (3);

a drain element (6);

an annular body (5) dimensioned to accommodate the drain element (6) and to be accommodated by the borehole (3), the annular body comprising a flat outer collar (19) that is dimensioned to be accepted by the annular cut-out (20), a body part (23) having a stepped inner profile and a conical outer surface, a first cylindrical wall (22) extending from an inner periphery of the flat outer collar (19) to the body part (23), and a second cylindrical wall (W) extending from the body part (23); and a reinforcement body (2) comprising an inner collar (11) comprising a horizontal end portion (H) delimiting a circular axial opening (9) dimensioned to receive the drain element (6), a flange (10), and a peripheral oblique wall (12) with a conical progression that extends between the inner collar (11) and the flange (10), the conical progression being outward from the inner collar (11) to the flange (10), wherein, in an assembled state, an end of the second cylindrical wall (W) rests on the horizontal portion (H) and the flat outer collar (19) is fully accepted by the annular cut-out (20) so as to be flush with the top surface (7).

12. The shower base panel module (100) of claim 11, wherein the conical outer surface of the body part (23) is adapted and configured to mate with the peripheral oblique wall (12) over an entirety of a length of the peripheral oblique wall.

13. The shower base panel module (100) of claim 11, wherein, in an assembled state, the annular body (5), and the reinforcement body (2) cooperate, via respective opposing directions, to reinforce the panel element (1) and eliminate torsion thereof.

14. The shower base panel module (100) of claim 11, wherein, in an assembled state, the annular body (5), and the reinforcement body (2) cooperate, via opposing directions, to reinforce the panel element (1) and eliminate torsion thereof, the annular body reinforcing in a direction from the top surface (7) toward the bottom surface (8), the reinforcement body reinforcing in a direction from the bottom surface (8) toward the top surface (7).

15. The shower base panel module (100) of claim 11, further comprising:

a pair of concentric, peripheral beads (13, 14) disposed on the flange (10); and an adhesive (15, 16) disposed in both beads (13, 14), wherein the reinforcement body (2) is attached to the panel element (1) by the adhesive (15, 16) so as to increase a rigidity of the panel element.

16. The shower base panel module (100) of claim 11, wherein the horizontal end portion (H) includes a linear segment, and wherein the oblique wall (12) includes a linear segment that is not in line with a linear segment of the horizontal end portion.

17. A shower base panel module (100), comprising:

a panel element (1) with a borehole (3) extending from a top surface (7) thereof to a bottom surface (8) thereof, the top surface (7) being adapted to receive tile thereon;

an annular body (5) dimensioned to accommodate a drain element (6) and to be accommodated by the borehole (3); and a reinforcement body (2) that includes an inner collar (11) consisting of a horizontal end portion (H) delimiting a circular axial opening (9) dimensioned to accommodate the drain element (6), a flange (10), and a peripheral oblique wall (12) with a conical progression that extends between and connects the inner collar (11) and the flange (10), the conical progression being outward from the inner collar (11) to the flange (10), the peripheral oblique wall (12) having a cross-sectional linear portion that defines a plane that does not intersect the inner collar (H), and a curved connection between the linear portion and the inner collar (11), and wherein, in an assembled state, the bottom surface of the annular body (5) rests on the horizontal end portion (H) of the inner collar (11), and wherein, in an assembled state, the annular body (5) and the reinforcement body (2) cooperate to reinforce the panel element (1) and eliminate torsion thereof, the annular body reinforcing in a direction from the first surface (7) toward the second surface (8), the reinforcement body reinforcing in a direction from the second surface (8) toward the first surface (7).

18. The shower base panel module (100) of claim 17, wherein the panel element (1) includes an outer edge (4) with a panel thickness (D2), and wherein, in an assembled state, (D2) does not exceed the thickness of a subfloor surrounding the panel element (1) so that the shower base panel module (100) is flush with the subfloor.

19. The shower base panel module (100) of claim 17, wherein, in an installed condition, the reinforcement body (2) is disposed at a level below the subfloor.

* * * * *